US005419791A

United States Patent [19]

Folmer

[11] Patent Number: 5,419,791

[45] Date of Patent: May 30, 1995

[54] METHOD OF HEAT ASSISTED SHEET METAL FORMING IN 360 DEGREE SHAPES

[76] Inventor: Carroll W. Folmer, 29781 Pebble Beach Dr., Sun City, Calif. 92586

[21] Appl. No.: 95,109

[22] Filed: Jul. 21, 1993

[51] Int. Cl.[6] ..... B21D 22/06

[52] U.S. Cl. ..... 148/585; 148/608; 148/626; 148/656; 148/669; 148/694; 148/695; 72/57; 72/60; 72/342.1; 72/357

[58] Field of Search ..... 148/564, 583, 585, 589, 148/608, 622, 628, 656, 669, 694–698; 72/57, 60, 342.1, 357, 360

[56] References Cited

U.S. PATENT DOCUMENTS

| | | | |
|---|---|---|---|
| 2,848,361 | 8/1958 | Howell | 148/589 |
| 3,649,375 | 3/1972 | Venkatesan | 148/564 |
| 3,988,913 | 11/1976 | Metcalfe et al. | 72/342.1 |
| 4,429,824 | 2/1984 | Woodward | 228/157 |
| 4,727,641 | 3/1988 | Kanatani et al. | 72/342.1 |
| 4,741,080 | 5/1988 | Larson et al. | 148/608 |
| 4,867,807 | 9/1989 | Torisaka et al. | 148/564 |
| 4,951,491 | 8/1990 | Lorenz | 72/60 |
| 4,984,732 | 1/1991 | Hudson et al. | 228/173.2 |
| 5,209,093 | 5/1993 | Cadwell | 72/62 |

*Primary Examiner*—George Wyszomierski

[57] ABSTRACT

This is a method for heat assisted forming, annealing, and hardening 360° sheet metal shapes in a clean environment in a single facility that results in dimensionally correct, cost-effective, contaminant free parts.

7 Claims, 13 Drawing Sheets

METHOD OF HEAT ASSISTED SHEET METAL FORMING IN 360 DEGREE SHAPES

CROSS-REFERENCE TO RELATED APPLICATIONS

The following inventions are being submitted to use the facility, dies, and the 360° sheet metal shapes produced in the facility.

A Method for Sheet Metal and Thermoplastic Bonded Assemblies in 360° Shapes

A Method for Forming 360° Sheet Metal Shapes Using Longitudinal End Loading

A Method for Forming Details and Adhesive Bonding of Sheet Metal and Composite Assemblies Sheet Metal Brazed Assemblies Liquid interface Diffusion Bonded Assemblies These inventions are described in U.S. patent application Ser. Nos. 08/095,108, 08/095,656, and 08/095,686, which are hereby incorporated by reference.

FIELD OF INVENTION

This invention relates to the production of sheet metal parts for the aerospace ant related industries.

DESCRIPTION OF PRIOR ART

There are some subcontractors who supply circular ant near circular sheet metal shapes to the aerospace industry and similar fields using means to apply pressure to the inside of a cylinder or cone of metal and expand the same metal to a die creating the desired shapes. The aerospace industry generally calls this process "BULGE FORMING".

The means to move the metal into contact with a varies between factories. Some use rubber or expandable molds that are inserted into a cylinder or cone of metal expanded with pumped water and soluble oil. Some use a cylinder of rubber that is compressed with end pressure to increase the diameter and force the metal cylinder or cone to the dies. Some use end loading in combination with the methods listed. All of the known Bulge Form suppliers form the metals cold.

Forming cold has the advantage of lower die and tooling cost. It avoids handling of hot parts but cold forming suffers from a number of disadvantages:

(a) Sheet metal parts are subject to a phenomenon Known as SPRINGBACK, especially cold formed sheet metals. The springback varies from lot to lot of sheet metal. The dies must be shaped to allow for the springback.

(b) Elongation is limited. It is very common to reach the limit of elongation during cold forming. When this happens it is necessary to remove the part and send it to an annealing oven. Once annealed the part can be formed again subject to the limit of elongation.

(c) The parts must be sent to an oven for solution treating. Fixturing to hold the part and to prevent warpage during treatment is expensive.

(d) Some parts, such as 6al 4v titanium simply can not be formed cold with any degree of success.

A review of the prior art revealed in U.S. Pat. Nos. 5,029,093 of Cadwell, 4,984,732 of Woodward, and 4,951,491 all limited to superplastic forming of titanium. The primary purpose of my invention is to heat form, solution treat, and age harden a multitude of materials in a single facility.

U.S. Pat. Nos. 4,984,732 and 4,951,491 require the use of an autoclave. My invention has the capability of pulling a vacuum on the die side of the blank and forming with argon on the heater side of the blank to delete the need for an autoclave. U.S. Pat. No. 5,029,093 does not require an autoclave, but it lacks the purity afforded by being able to pull a vacuum on the die side of the sheer metal.

The delta alpha sealing system of U.S. Pat. No. 4,429,824 is questionable in production when substantial deformation in the radial direction is required. The sealing system shown in U.S. Pat. No. 5,029,093 is perfectly adequate but I prefer the additional expansion available from an inflatable seal to handle out of tolerance blanks.

Superplastic forming is but one aspect of my invention as it will be used to form a multitude of materials with the appropriate heat for maximum elongation. The inflatable seal shown will work for all temperatures but commercially available rubber seals up to 500° F. and inflatable mesh seals up to 1000° F. can be purchased and used more cost effectively at the lower temperatures.

OBJECTS AND ADVANTAGES

Accordingly, besides the objects and advantages of the sheet metal forming method described in my patent, several objects and advantages of the present invention are:

(a) to provide controlled heat as a means to achieve the maximum elongation during forming.

(b) to provide controlled heat and cooling means to anneal sheet metal in the same facility it is formed in.

(c) to provide controlled heat and cooling means to solution heat treat and artificially age sheet metal in the same facility it is formed in.

(d) the same forming dies used to form parts become holding fixtures during hardening to stabilize the part under pressure and minimize warpage.

(e) to provide a means to form sheet metal in a clean atmosphere with minimal contamination by using a combination of vacuum and argon gas.

(f) to provide parts that can be formed directly to the dies without springback due to the use of heat.

(g) to provide a method for forming of perforated sheet metal using a slave sheet to form said perforated metal with the minimal elongation of perforated holes.

(h) to provide a method for forming of thermoplastic shapes using a slave sheet.

(i) to provide means of attaining close tolerance sheet metal shapes that are impossible to hold by current manufacturing facilities and methods.

(j) To provide the means of attaining the best possible fit to the dies by using not forming to relieve the internal stresses in sheer metal during forming.

BRIEF DESCRIPTION OF THE DRAWINGS

FIGS. 1 through 13 are intended to present an overview of the forming methods. Dies are currently planed as singular, dual and triple. Most figures apply to dual dies as it will be the most common usage.

FIG. 1 shows an overall view of the hot forming facility with triple die positioners.

FIG. 2 shows the triple die configuration translated and shows a rotatable quencher.

FIG. 8 shows a composite view of a typical sheet metal shape inside the facility.

FIG. 9 shows a section cut through the sheet metal part and facility.

FIG. 10 shows an enlargement near the upper end of the sheet metal shape.

FIG. 11 shows an enlargement near the lower end of the sheet metal shape.

FIG. 12 shows a slave sheet being used to form perforated sheet metal and thermoplastic shapes.

REFERENCE NUMERALS IN DRAWINGS

14 Overhead Transfer Beam
16 Part Loading Winch
18 Cast and Die Winch
20 Controller and Recorder
22 Hydraulic Triple Die Positioning Base
24 Heater Bank Mount Ring
26 Preform
26B Formed Shape From 26
28 Case
30 Die
30B Die Similar to 30
32 Heater Core Holder
34 Heating Elements
36 Upper Inflatable Impingement Seal
38 Lower Inflatable Impingement Seal
40 Upper Seal Retainer
42 Lower Seal and Part Retainer
44 Upper Seal, Case to Holder
46 Lower Seal, Holder to Base
48 Lower Seal, Case to Base
50 Forming Pressure Tube
52 Upper Seal Pressure Tube
54 Lower Seal Pressure Tube
56 Hydraulic Dual Die Positioning Base
58 Perforated Sheet Metal Shape Before Forming
58B Perforated Sheet Metal Shape After Forming
60 Thermoplastic Detail Before Forming
60B Thermoplastic Detail After Forming
62 Quencher

DETAILED DESCRIPTION OF THE INVENTION

FIGS. 1 through 13 are intended to present an overview of the forming methods. Dies are currently planed as singular, dual and triple. Most figures apply to dual dies as it will be the most common usage.

Figure 1:
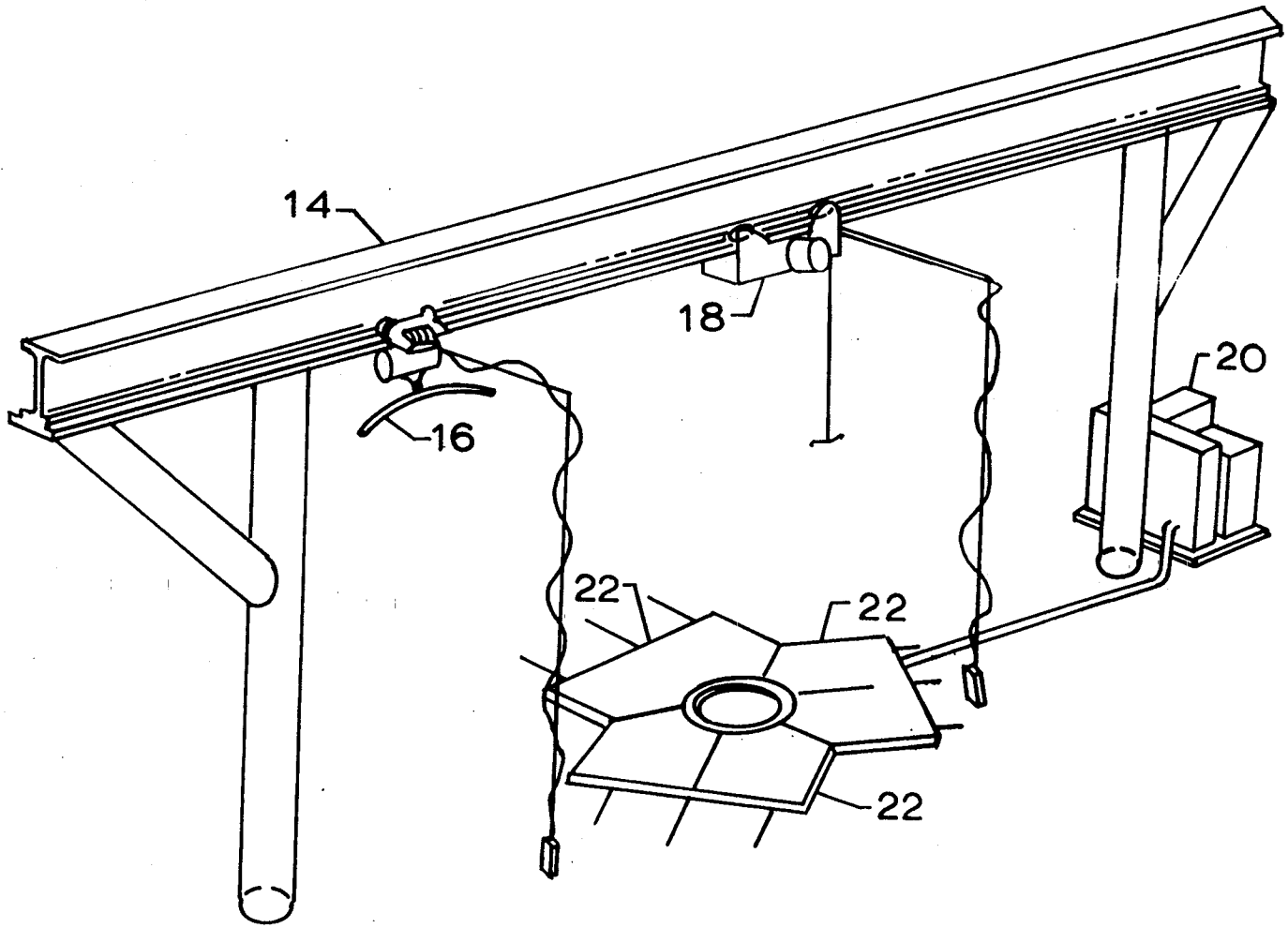

FIG. 1 shows an overall view of the hot forming facility with hydraulic positioning bases 22 for three dies to provide horizontal movement of dies. The bases 22 index to a heater core holder mount ring 24. Three dies offer an ability to remove parts that would be trapped on a single die or a dual die. Winches mounted to an overhead frame 14 provide vertical movement. One winch 16 is for parts and lightweight duty. The second winch 18 is for heavy cases and dies. The controller recorder 20 controls the application of heat, pressure, and cooling over time.

Figure 2:
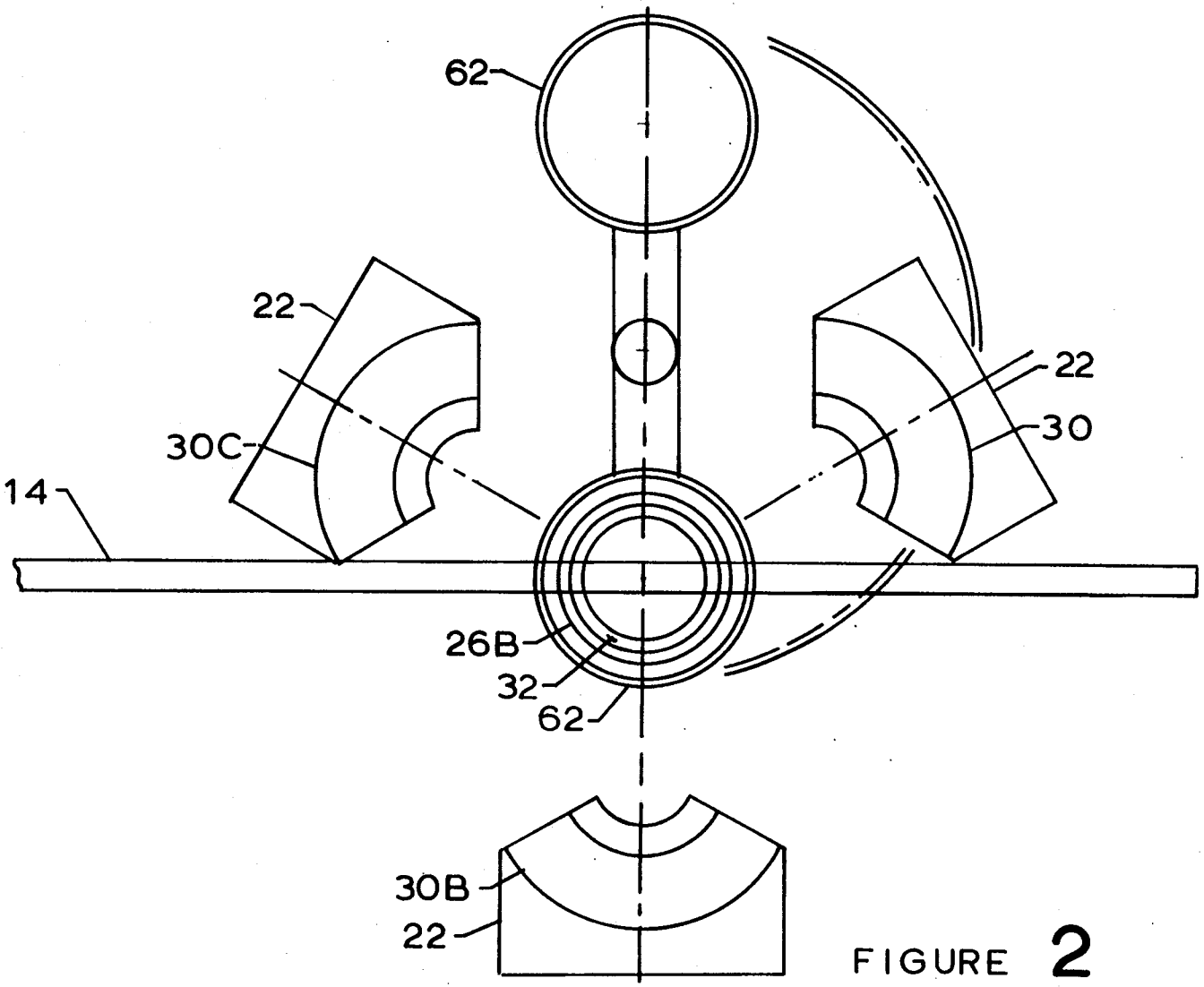

FIG. 2 is a view looking down on the triple hydraulic positioning bases 22 and dies 30, 30B, and 30C after translation. A quencher 62 is shown rotated from its stowed position at the top of the figure to a position directly above the sheet metal shape 26B and heater core 32. In FIG. 2 the quencher 62 would be in the up position to clear the dies.

Figures 3A, 3B:
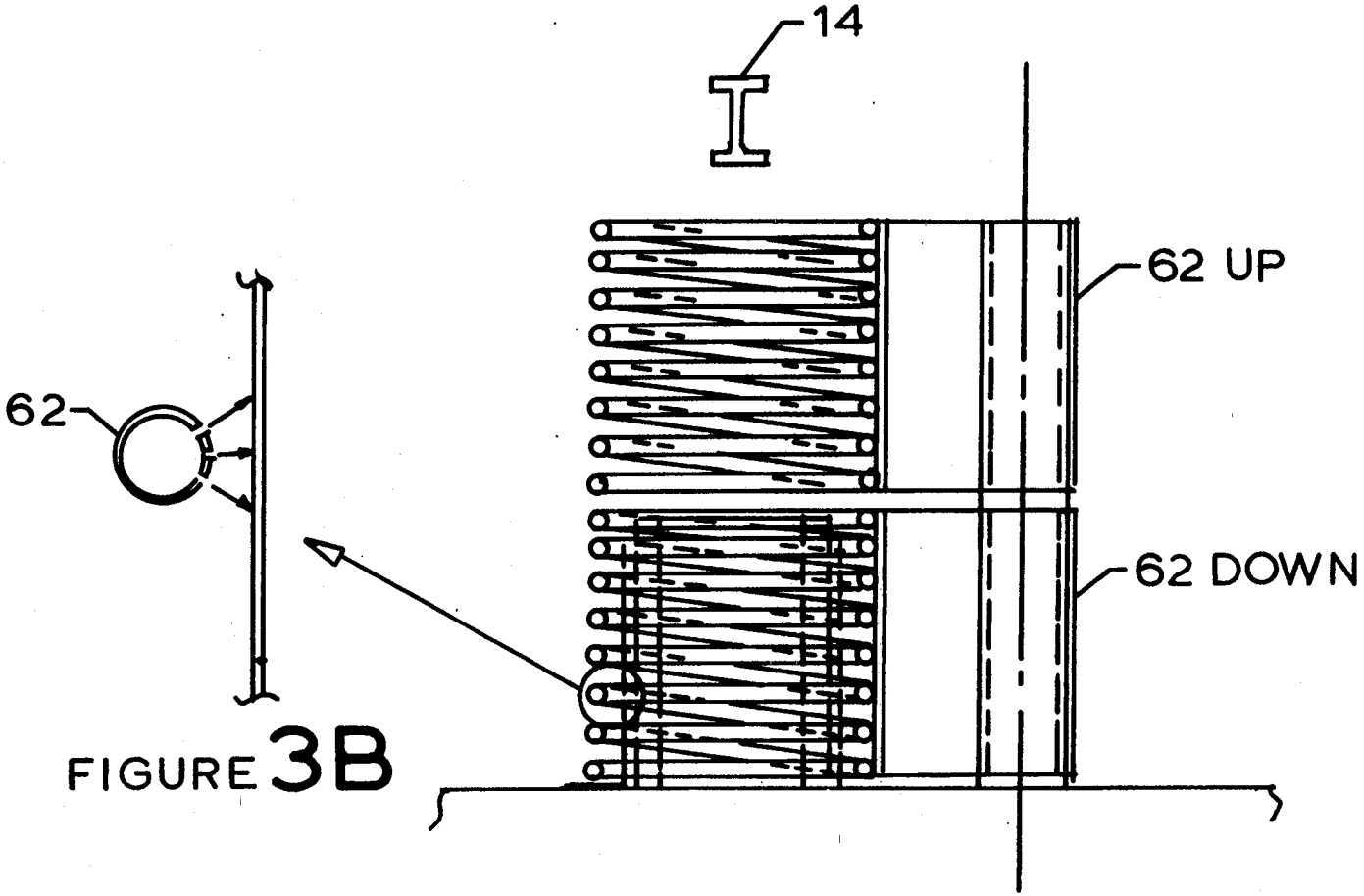
FIGS. 3A and 3B show the quencher in the up position and in the down position surrounding the sheet metal shape.
Figure 4B:
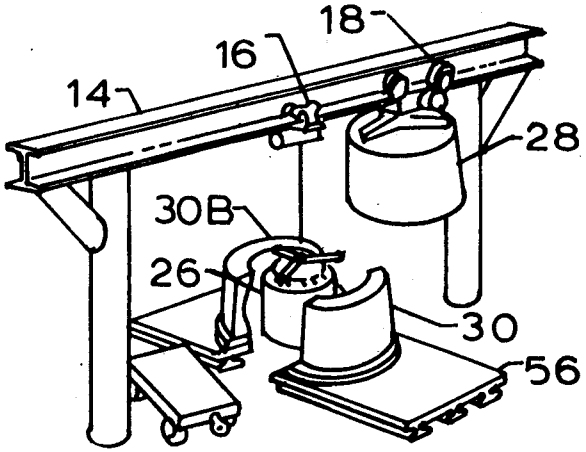
FIGS. 4A thru 4D show the dual die configuration which will be the most common configuration.
Figure 4D:
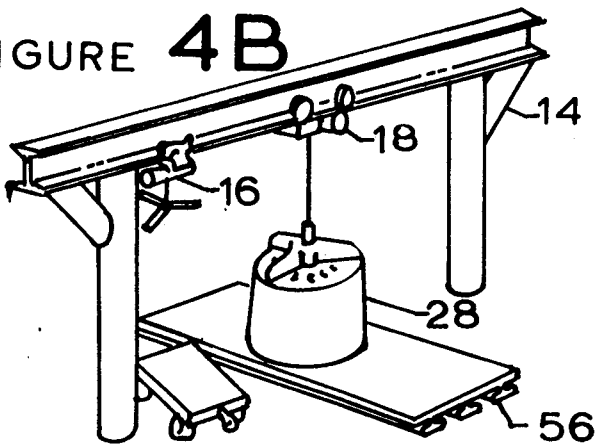
Figure 4A:
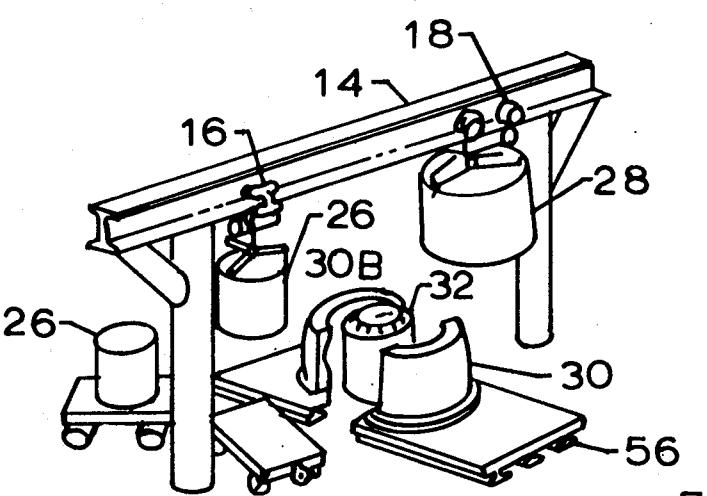
Figure 4C:
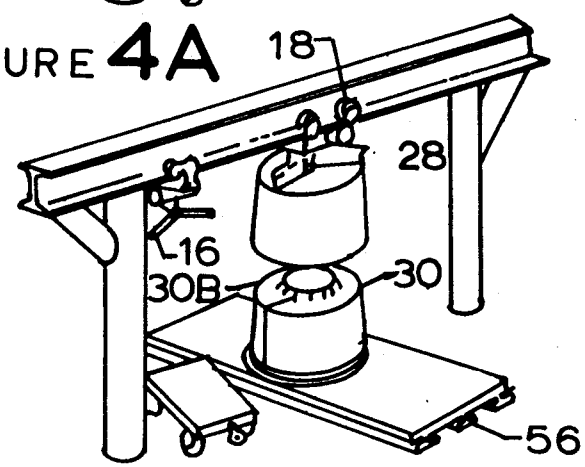
Figures 4E, 4F, 4G, 4H:
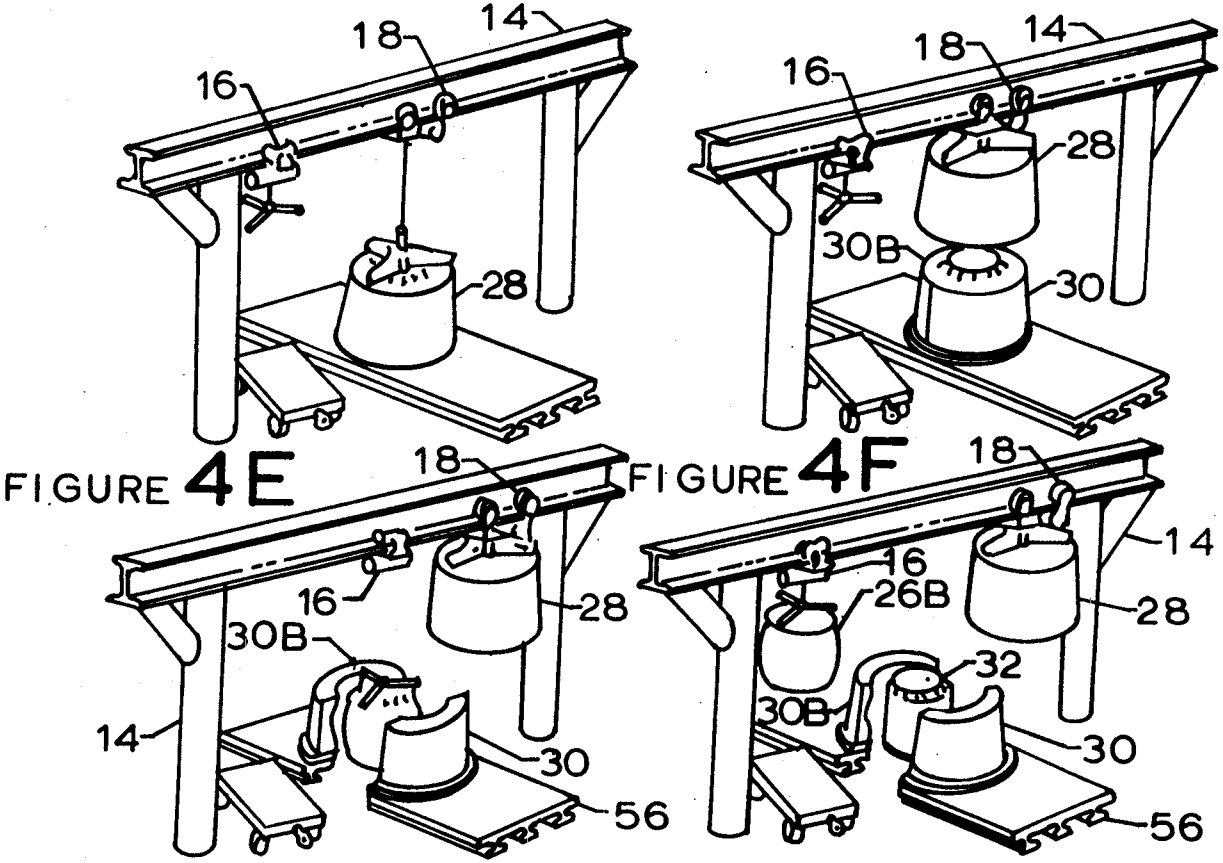
FIGS. 4E thru 4H continue the dual die forming and removal configuration.

FIG. 3 is a section cut through the quencher to illustrate the up position where rotation occurs and the down position where it is surrounding the sheet metal shape 26B. There is an enlarged view that shows a piccolo type of spray for either water or air.

FIG. 4 shows the dual die configuration which will be the most common application. A 360° preform 26 is lifted from a cart by the part winch 16 and placed over the heater core holder 32. See FIG. 7 for a depiction of a preform being prepared. The dies 30 and **30*b* are translated into position, using the hydraulic dual die positioning base 56, and the case 28 is placed over the dies by the heavy duty winch 18. The case fits firmly to the dies as it resist the forming gas pressure. If forming titanium a vacuum is pulled on the outside of the case or die side of the preform and gas pressure, usually argon, is then applied to the heater core holder side of the preform. See FIG. 5** for a depiction of the relationship of vacuum and argon. If using a metal that is not contaminate sensitive the vacuum/argon system is not required.

FIGS. 4E–4H continue the dual die forming and removal sequence. Gas pressure will force the heated preform 26 to elongate and take the shape of the dies. The case 28 is removed. The dies 30 and **30*b* are translated away from the part. The part 26B** is then removed. The operation noted assumes parts used in the annealed condition. Hardened parts will require additional operations.

Figure 5B:
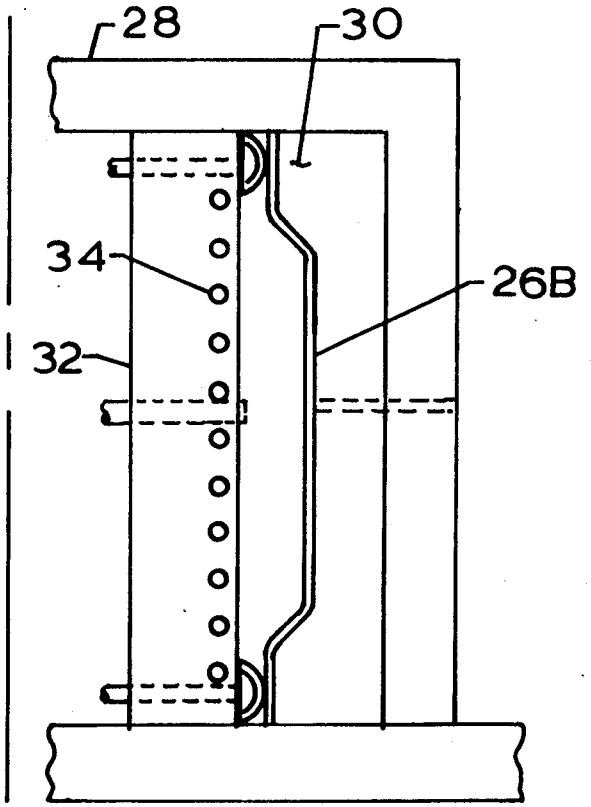
FIGS. 5A and 5B are schematics to illustrate the relationship of vacuum and argon especially with titaniums which are very susceptible to contaminates.
Figure 5A:
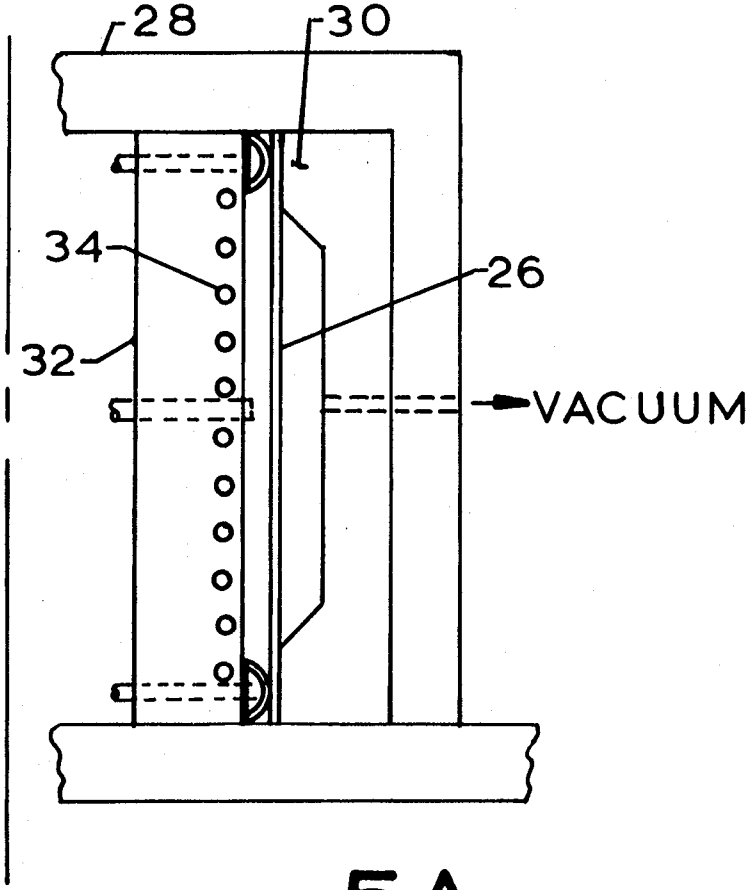

FIG. 5 is a schematic to illustrate the relationship of vacuum and argon especially with titaniums which are very sensitive to contaminates. This is an illustration of the Beta 21-S titanium operation. The importance of the vacuum and argon can not be overstated as it provides a practical cost effective clean atmosphere.

Figure 6B:
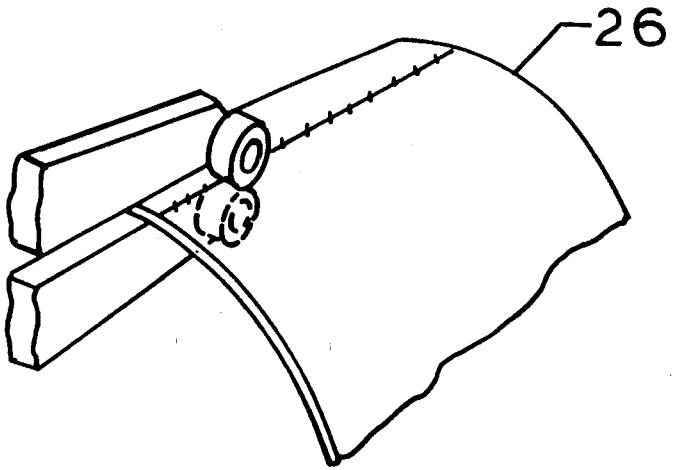
FIGS. 6A and 6B show sheer metal being prepared as a preform by being welded, roller, and planished into a 360° shape.
Figure 6A:
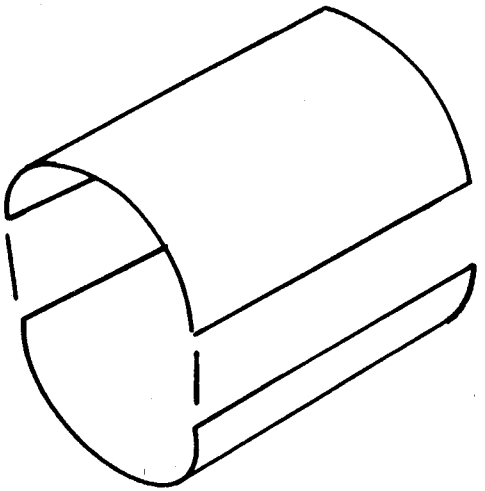

FIGS. 6A and 6B show sheet metal being prepared as a preform by being welded, rolled, and planished into a 360° shape.

Figure 7B:
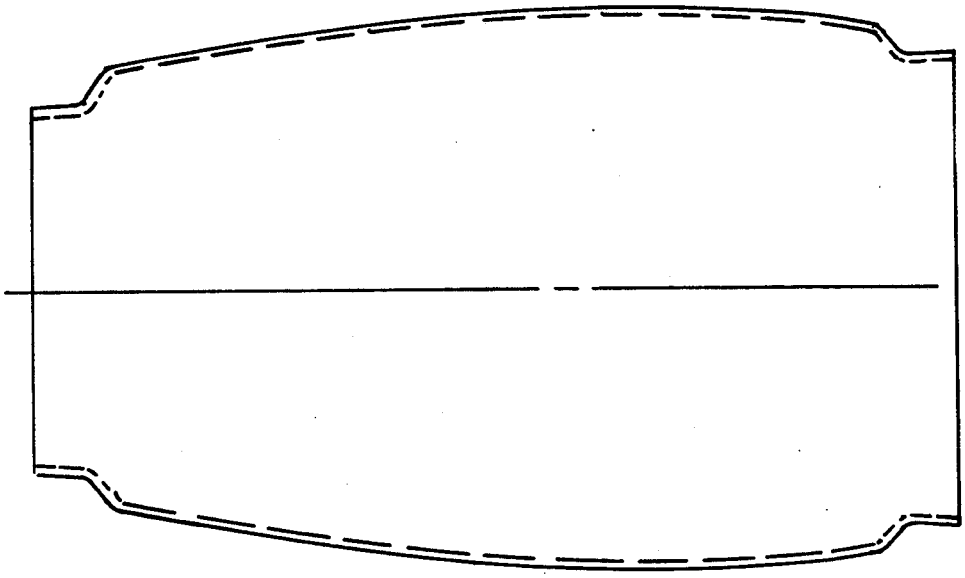
FIGS. 7A and 7B show before and after shape of a 360° sheet metal shape.
Figure 7A:
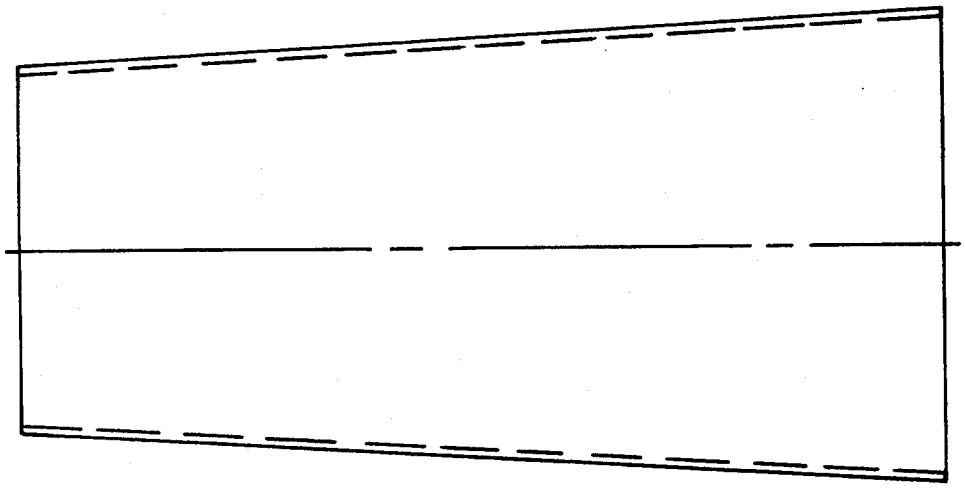

FIGS. 7A and 7B show before 26 and after shape **26*b*** of a 360° sheet metal shape.

Figure 8:
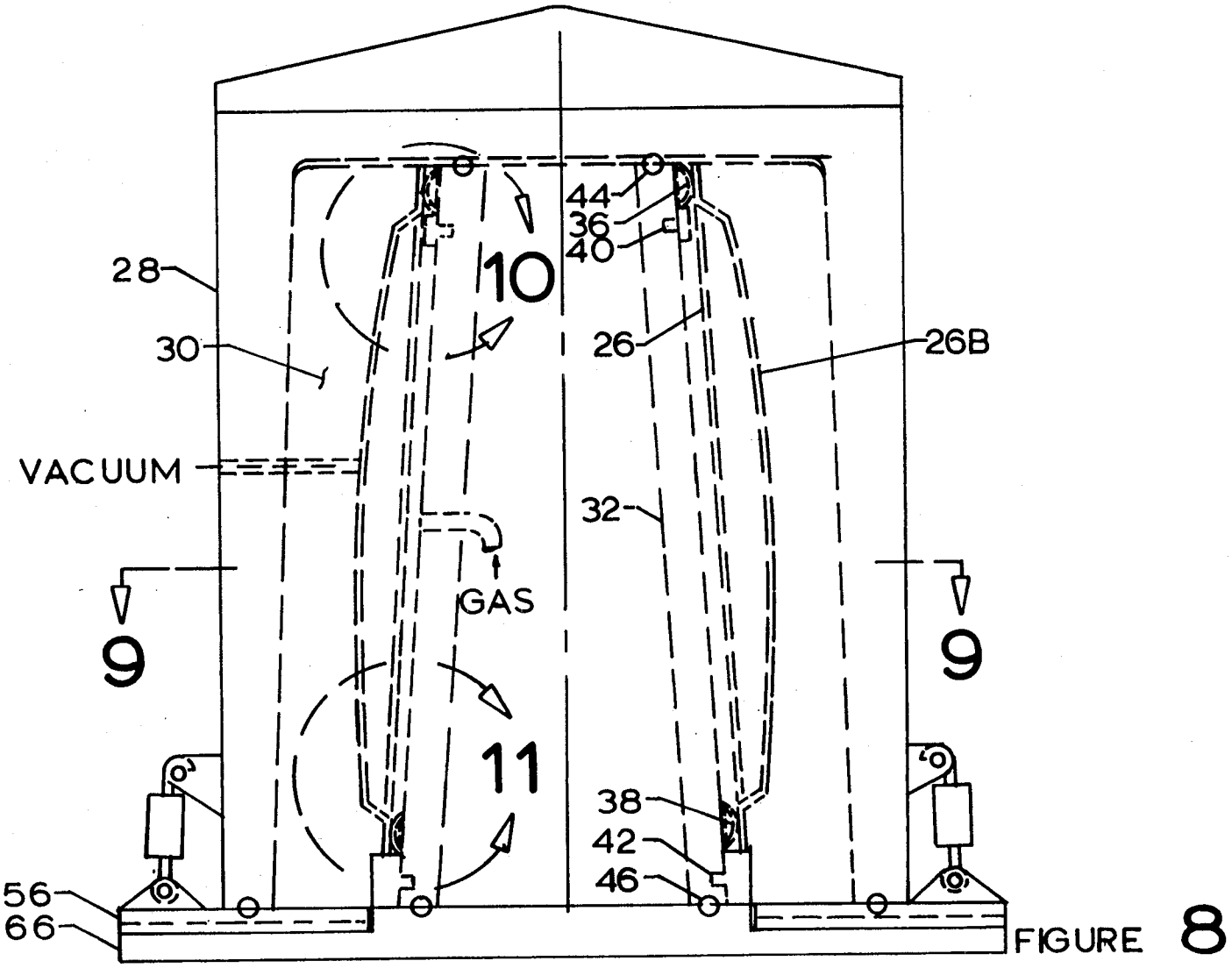

FIG. 8 shows a composite view of a typical sheet metal shape 26B inside the facility. The sheet metal shape is shown in the before 26 and after forming 26B shapes. The composite view shows that the case 28 is sealed with 44 to the heater core holder 32 and to the base plate 56 with seal 48. The heater core 32 is sealed to the baseplate 54 with seal 46. This allows a vacuum to be pulled on the outside of the part. Gas pressure inflates the end seals 36 and 38. Gas forming pressure, argon, if forming titanium for contaminate control, can then be applied to the preform 26 forcing it to take the shape of the die 30. This same facility can and will be used for annealing and hardening of materials.

Figure 9:
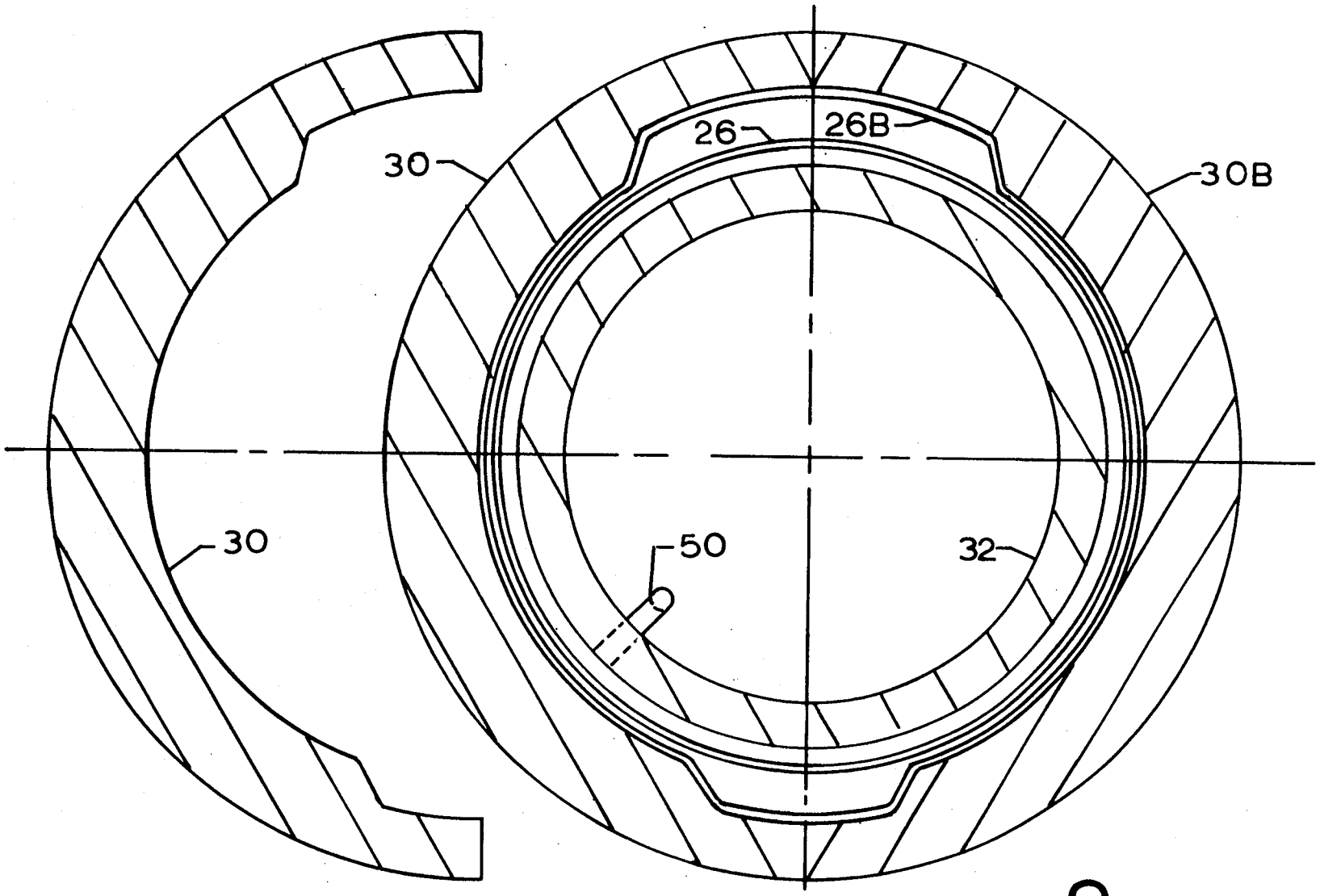

FIG. 9 shows a section cut through the shape. It illustrates that the dies 30 are translated away from the part 26B, for part 26B removal, or heating and cooling during hardening.

Figure 10:
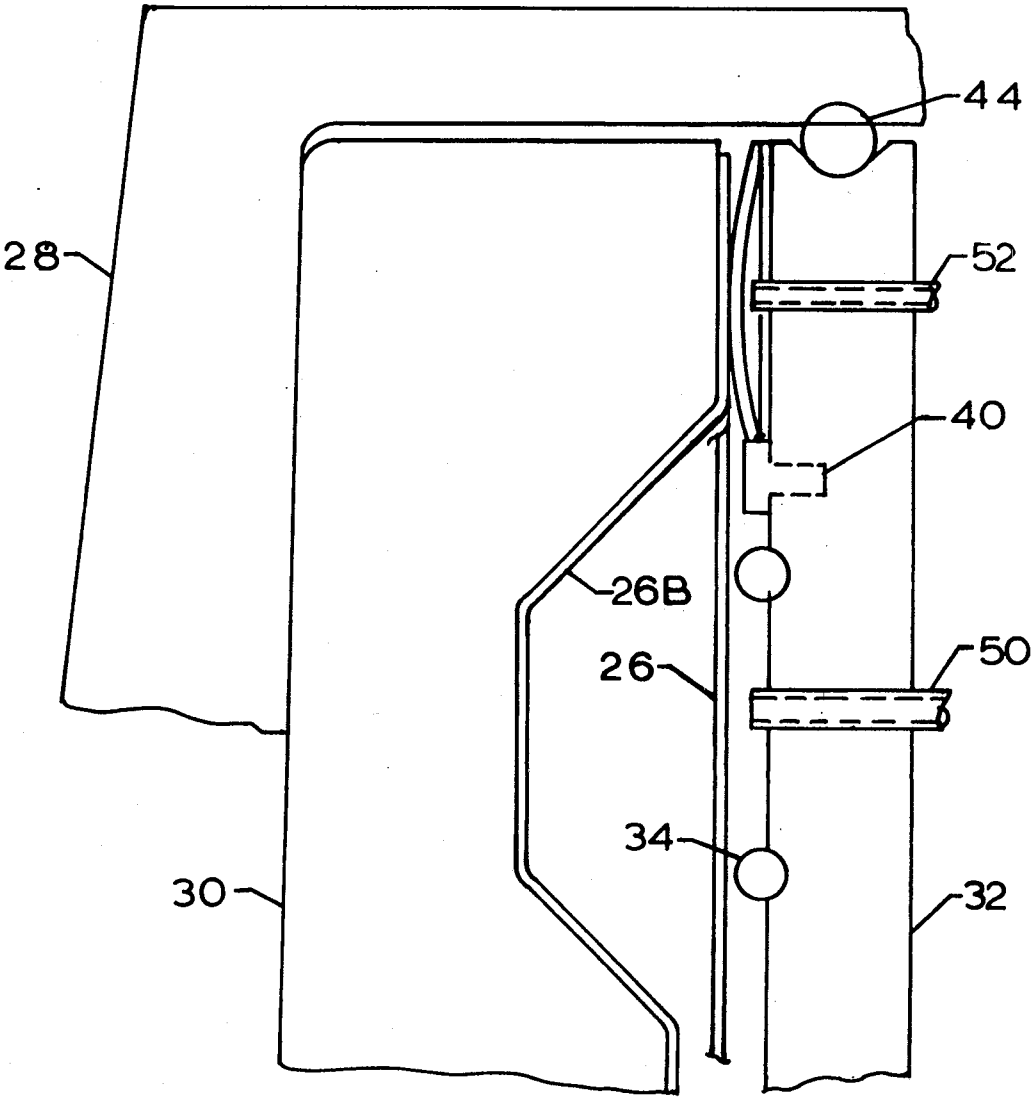

FIG. 10 shows an enlargement of the upper end of the shape 26B and preform 26. It illustrates the case 28 is sealed to the heater core holder 32 by compressing a seal 46. It illustrates that the inflatable impingement seal 36 is pressurized with gas through a delivery tube 52. The impingement seal is retained with step-pins 40. With the ends sealed and the heaters 34 activated, gas pressure, is applied to the preform 26 and results in the finished shape 26B taking the shape of the die 30.

Figure 11:
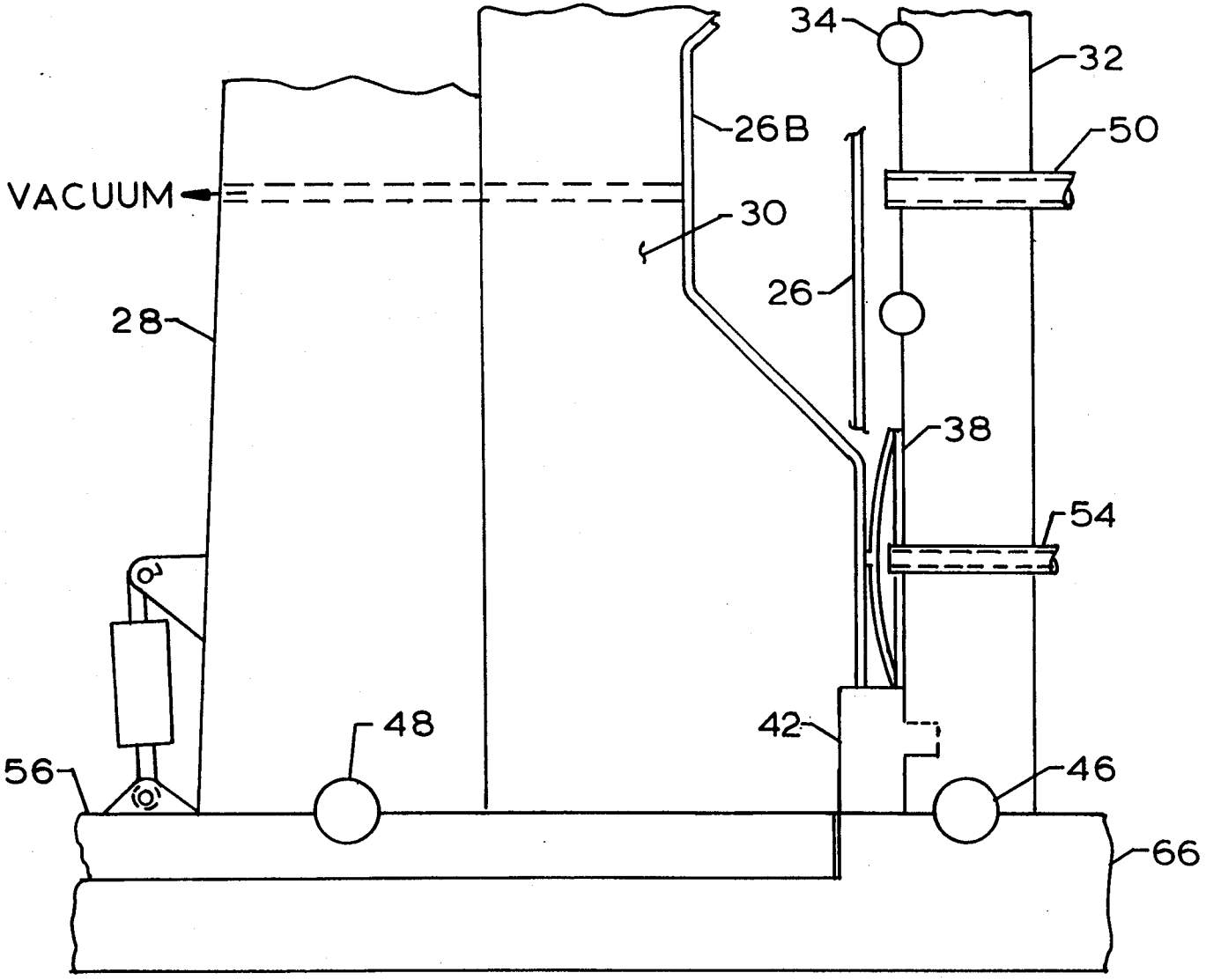

FIG. 11 shows an enlargement of the lower end of the shape 26B and preform 26, It Illustrates the case 2B sealed to the base 56 by compressing a seal 4B, The heater core holder compresses a seal 46 affecting a seal to the base 56. The inflatable impingement seal 38 is pressurized through the delivery tube 54. A vacuum can then be pulled on the die side. The heaters 34 are activated and forming gas pressure is delivered through the delivery tube 50. The preform will take the shape 26B of the die 30. Since it may be necessary to remove the case 28 and translate the die 30 away from the part 26B a combination seal-part retainer 42 is required. We now have the capability to form, anneal, and harden a part in a clean environment.

Figure 12:
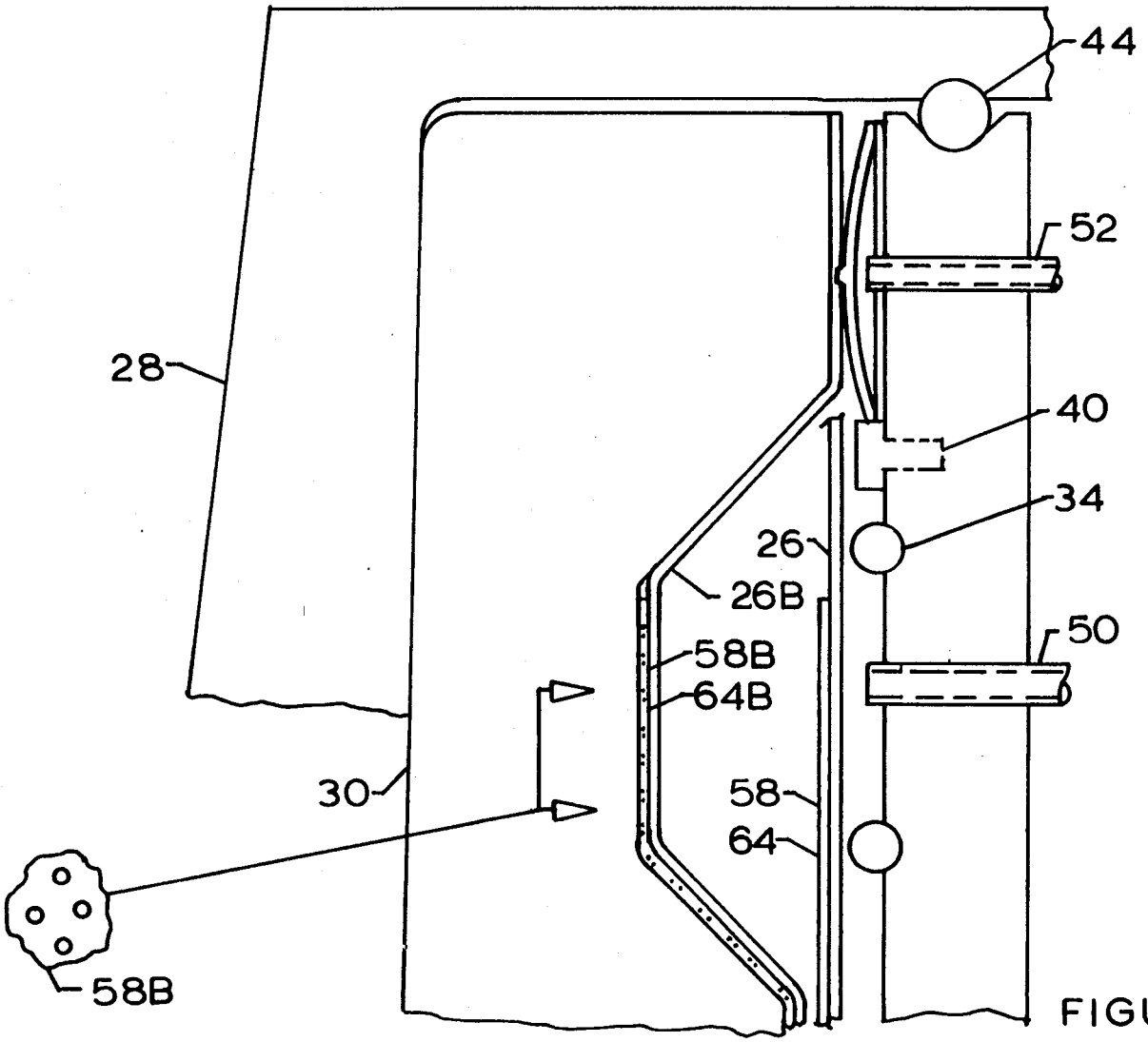

FIG. 12. A common part used in the aerospace industry is a perforated sheet metal shape 58B used in acoustic applications. Obviously the perforated sheet will not hold gas pressure. The answer lies in using the preform 26 as a slave sheet to cause the perforated detail 58 to take the finished shape 58B of the die 30. The perforated detail 58 does not have to be a 360° shape but it does have to be indexed by tack welding or some means to the 360° preform shape. A theromoplastic detail 60 would be formed the same as the perforated detail 58. Everything noted in FIGS. 11 and 12 are the same with the detail 58 or 60 added as indicated.

From the description above, a number of advantages of my heat-assisted 360° sheet metal forming method is evident:

(a) By sealing the case to the base and the heater core holder we can combine a vacuum system and an argon gas system to provide a very clean forming atmosphere cost effectively. Titanium parts produced in this facility will be almost contaminate free.

(b) The preform is placed very close to the heater core holder. This allows for uniform heating as the heater coils will span the length of the holder. Optimum heat will be selected for elongation. The controller/-recorder will direct heat and pressure to the part. This results in the maximum elongation possible.

(c) Although heat assisted forming will obtain the most effective elongation possible, there may be an instance when it is not enough for the part to reach the die. If so, the part can be annealed in place using standard recommended heating-cooling specifications. After annealing the part, forming can be continued. This avoids sending the part to a separate location in the factory to be annealed or worse yet to an oven in another factory.

(d) After forming, some materials will need to be hardened. Hardening like annealing can be done in place in this facility avoiding the need for additional ovens or shipping difficulties. An example would be 2219 aluminum. The aluminum is formed just shy of finished forming. It is then solution treated by heating to 850° farenheit. The case is removed and the dies translated away from the sheet metal shape. A quencher is rotated and lowered into position surrounding the sheet metal shape. The sheet metal shape is water quenched with a fine mist. The quencher is removed, dies rotated into position and the shape is then formed in the as quenched condition and age hardened under pressure. This eliminates the problem of warpage and the use of special tools to hold the part during hardening.

(e) This facility and some of the same dies and parts formed on the dies will be used in sheet metal bond assemblies. This will save bond tooling and produce other advantages. See the cross-referenced sheet metal bonded assemblies.

This facility hag been designed to provide several services in a small area. The following are the steps necessary to produce a finished part:

(e) A heater core holder 32 is installed to the mount ring 24. The holder compresses a seal 46 to effect sealing between the holder and the base.

(b) A preform 26 is lifted with the part handling winch 16 and installed over the holder 32.

(c) Dies 30 and 30B are translated using the hydraulic dual die position)rig base 56 to the mount ring 24.

(d) A case 28 is then installed over the dies with the case and die winch 18. The case has a tight fit over the dies as it resist the forming pressure. The case compresses an upper seal 44 to the holder and a lower seal 46 to the base.

(e) Upper 36 and lower 38 impingement seals are inflated with gas pressure to effect a seal to the preform 26. Heat is activated by the controller 20.

(f) If forming titanium a vacuum is pulled on the die side of the preform and argon gas is caused to be applied by the controller/recorder 20 to the heater core holder 32 side of the preform 26 to evacuate oxygen.

(g) The controller/recorder 20 causes heat to reach the proper forming temperature and causes forming gas to be applied to the preform 26 at a controlled rate forcing it to the dies.

(h) Upon die contact a part is formed. If a part reaches its elongation limit before contacting a die it is necessary to anneal the part in place by applying recommended temperatures and cooling per accepted specifications.

(i) As stated in (hi upon die contact a part is formed, This is true for those parts used in the as formed or annealed condition, Some materials need to be hardened, The following materials are grouped and are presented for for an understanding of material types that can be formed in this facility and to define those that will be left in the annealed condition or require solution treatment.

| | Cond. |
|---|---|
| Wrought Aluminum: | |
| 6061 | SOL |
| 7075 | SOL |
| 2219 | SOL |
| 2024 | SOL |
| 2014 | SOL |
| Titanium Base Alloys | |
| Commercially Pure 40K | ANN |
| Commercially Pure 55K | ANN |
| Commercially Pure 70K | ANN |
| 6AL- 4V | ANN |
| 6-2-4-2 | ANN |
| 6-6-2 | ANN |
| Beta-21-S | SOL |
| 15-3-3-3 | SOL |
| CORROSION & HEAT RESISTENT | |
| AUSTENITIC IRON BASE ALLOYS | |
| 302 | ANN |
| 321 | ANN |
| 347 | ANN |
| CORROSION & HEAT RESISTENT | |

-continued

| | Cond. |
|---|---|
| MARTENSITIC & FERRRITIC IRON BASE ALLOYS | |
| GREEK ASCOLOY | ANN |
| 17-7-PH | SOL |
| 15-7-PH | SOL |
| CORROSION & HEAT RESISTENT PRECIPITATION HARDENABLE IRON BASE ALLOYS | |
| A286 | SOL |
| WROUGHT NON-HARDENABLE NICKEL BASE ALLOYS | |
| INCONEL 600 | ANN |
| INCONEL 601 | ANN |
| INCONEL 625 | ANN |
| WROUGHT PRECIPITATION HARDENABLE NICKEL BASE ALLOYS | |
| INCONEL 706 | SOL |
| INCONEL 718 | SOL |
| INCONEL 750 | SOL |

The materials listed are representative only and do not imply that a material not listed can not be formed in this facility. (j), (k), (l) and (m) describe operations necessary to harden different materials.

(j) 2219 alumimum is formed just shy of finished forming. Dies 30 and 30B are translated away from the preform 26. It is then solution treated by heating to 850° farenheit and water quenched per specification with a fine mist. The dies are immediately translated back into the forming position. The preform 26 is then formed in the as quenched condition and age hardened under pressure to produce the finished product 26B. This eliminates the problem of warpage and special tools to hold the parts during hardening.

(k). Beta 21-S titanium is formed at approximately 1285 degrees farenheit and held against the die under pressure for 8 hours. The temperature As reduced to approximately 200 degrees farenheit and held under pressure 8 more hours. The temperature is reduced to 900 degrees farenheit before exposing the part to the atmosphere in order to minimize contamination. Note that the material is held under pressure against the forming dies to minimize distortion.

(l) The stainless steels, 15-7-PH and 17-7-PH require heating and air cooling to achieve the desired hardening. To attain the condition TH1050—The material is annealed at 1950° F., air cooled, heated to 1400° F. for 1.5 hours, air cooled to 60° F. for 0.5 hours, heated to 1050° F. for 1.5 hours and air cooled. The sheet metal shapes are held against the die while heated to minimize the distortion.

(m) 718 inconel is solution treated by heating to 1850° farenheit and rapid air cooled per specification. Age harden by holding at 1450° farenheit for 8 hours. Cool by reducing the heat 50° farenheit per hour to 1275° farenheit and hold under pressure for 8 more hours. Air cool.

(n) 6AL-4V, 6-6-2, and 6-2-4-2 titaniums are formed in the superplastic state at approximately 1650 degrees farenheit. The aerospace industry has accepted the use of the material in the annealed state, but the material will be held in the facility and the temperature reduced to 900 degrees in the clean environment before being exposed to the atmosphere to minimize contamination, hydrogen enrichment and an alpha case.

(o) Virtualy all solution treated and age hardened materials can be formed, annealed, and hardened in this facility. All of the materials including those left and used in the annealed state benefit from being formed at the optimum forming temperature and from the clean atmosphere created by being formed in the vacuum/argon atmosphere when necessary.

SUMMARY

Accordingly, the reader will see that a multitude materials can be formed in this facility cost effectively and with minimal contamination in that:

a) The non-recurring cost of the dies is minimized as they are per engineering and they do not have to be adjusted to allow for springback due to the use of heat-assisted forming.

b) Maximum elongation is attained by selecting the optimum forming temperature and controlling it with the controller/ recorder.

c) This facility is designed to use vacuum/argon when appropriate. Titanium parts formed in this facility are almost contaminate free. This is very important for titanium parts which are susceptible to alpha case and hydrogen enrichment.

d) Materials can be annealed in place in this facility avoiding the costly and time consuming practice of sending the part to another oven or to another factory.

e) Materials can be hardened in place in this facility avoiding the costly and time consuming practice of sending the part to another oven or to another factory.

f) The forming dies can be used as fixtures and the parts can be held under pressure during hardening to avoid warpage.

g) The ability to adjust and control the temperature and pressure at a controlled rate allows forming of aluminum, steel, and titanium not suitable for cold forming.

Although the summary description contains many specificities, these should not be construed as limiting the scope of the invention, but as merely providing illustration of some of the presently preferred embodiments of the invention. For example, other uses of the facility have been identified in the Cross-References to Related Applications.

Thus the scope of the invention should be determined by the appended claims and their legal equivalents, rather than by the examples given.

I claim:

1. Apparatus for heat assisted forming, annealing, and hardening a tubular preform member formed of sheet metal that has a 360 degree outer surface in a clean environment in a single facility comprising:

a base having a top surface;

a heater core holder having a top surface, a bottom surface, and a gas passage way having an outlet port on an outer side wall surface; said heater core holder being capable of having a tubular preform member formed of metal placed over it;

means for sealing the bottom surface of the heater core holder to the top surface of said base;

a die assembly having a top surface, a bottom surface, an inner surface and upright oriented outer side wall surfaces; said die assembly having a cavity formed in its bottom surface that allows said die assembly to be positioned to surround a tubular preform member placed over said heater core holder; said die assembly containing heating elements;

a case having a bottom surface having a cavity formed therein that allows it to be positioned over said die assembly; said cavity having an inner surface;

means for sealing the bottom surface of said case to the top surface of said base;

means for sealing the top surface of said heater core holder to the inner surface of the cavity formed in the bottom surface of said case;

means for supplying pressurized gas to the gas passageway in said heater core holder for applying gas pressure to the inner surface of a tubular preform member lowered over said heater core holder so as to cause the sheet metal of the preform to elongate and take a shape approximating that of the cavity of said die assembly; and a tubular quencher assembly and means for lowering it over said heater core holder after a preform has been die formed and while it still surrounds said heater core holder and after the case and die assembly have been removed from the heater core holder.

2. Apparatus as recited in claim 1 further comprising a passageway through said case and die assembly that communicates with the interior of said die assembly cavity and means for drawing a vacuum through said passageway so as to cause a vacuum to be applied to the outer surface of a tubular preform member installed over said heater core holder.

3. Apparatus as recited in claim 2 further comprising a controller recorder that is connected to (a) the heating elements of said heater core holder, (b) the gas passageway in said heater core holder, and (c) said vacuum passageway, said controller recorder comprising means to control the application of heat, pressure and cooling to said heater core and die assembly over time.

4. A method for heat assisted forming, annealing, and hardening a sheet of metal material that has been preformed into a tubular shaped preform with the process being performed in a clean environment in a single facility, said method comprising the step of;

(a) positioning a heater core holder on a base;

(b) positioning said tubular shaped preform around said heater core holder and within a plurality of dies;

(c) closing said dies around said tubular shaped preform and said heater core holder;

(d) positioning a case over said dies with its bottom surface contacting said base;

(e) providing a gas tight seal between (1) the top of said heater core holder and the said case, (2) the bottom of said heater core holder and said base, (3) the bottom of said case and said base, and (4) said tubular shaped preform and said heater core holder;

(f) applying gas pressure to the side of said tubular shaped preform facing said heater core holder at an elevated temperature so as to cause the metal material to elongate and take a formed tubular shape approximating that of said dies;

(g) removing the case and dies from the formed tubular shape;

(h) moving a quenching apparatus into position surrounding said formed tubular shape and said heater core holder;

(i) water quenching said formed tubular shape;

(j) removing said quenching apparatus;

(k) closing said dies around said formed tubular shape and positioning said case over said dies;

(l) further forming said tubular shape in the as quenched condition and age hardening under pressure.

5. The method of heat assisted forming, annealing and hardening as recited in claim 4 wherein said metal material is titanium and the gas applied in step (f) is argon.

6. The method of heat assisted forming, annealing and hardening as recited in claim 5 further comprising during the step (f), drawing a vacuum on the side of said tubular shaped preform facing said dies.

7. The method of heat assisted forming, annealing and hardening as recited in claim 4 wherein an annealing operation is performed on the formed tubular shape after step (f) but before step (g).

* * * * *